US007627984B2

(12) United States Patent
Wallerstorfer

(10) Patent No.: US 7,627,984 B2
(45) Date of Patent: Dec. 8, 2009

(54) ROTATING BARRIER

(75) Inventor: Kurt Wallerstorfer, Irrsdorf (AT)

(73) Assignee: SkiData AG, Gartenau (AT)

( * ) Notice: Subject to any disclaimer, the term of this patent is extended or adjusted under 35 U.S.C. 154(b) by 545 days.

(21) Appl. No.: 11/372,455

(22) Filed: Mar. 9, 2006

(65) Prior Publication Data

US 2006/0225351 A1 Oct. 12, 2006

(30) Foreign Application Priority Data

Mar. 9, 2005 (DE) ..... 10 2005 010 714

(51) Int. Cl.
*E06B 11/08* (2006.01)

(52) U.S. Cl. ..... 49/47

(58) Field of Classification Search ..... 49/42, 49/44, 46, 47, 13, 14
See application file for complete search history.

(56) References Cited

U.S. PATENT DOCUMENTS

| | | | | |
|---|---|---|---|---|
| 1,617,918 | A * | 2/1927 | McLoughlin | 49/47 |
| 2,019,326 | A * | 10/1935 | Stuart | 49/47 |
| 2,144,718 | A * | 1/1939 | Gersbach | 49/47 |
| 3,978,613 | A * | 9/1976 | Hayward et al. | 49/46 |
| 4,142,620 | A * | 3/1979 | Sheehan | 194/251 |
| 4,525,951 | A * | 7/1985 | Williams | 49/47 |
| 4,640,046 | A * | 2/1987 | Rushford | 49/44 |
| 5,471,795 | A * | 12/1995 | Gallenschutz et al. | 49/506 |
| 5,592,778 | A * | 1/1997 | McGuire | 49/42 |
| 5,605,015 | A * | 2/1997 | Uhl et al. | 49/47 |
| 5,704,163 | A * | 1/1998 | Kocznar | 49/47 |
| 6,044,586 | A * | 4/2000 | Wotke | 49/47 |
| 6,076,302 | A * | 6/2000 | Otto | 49/44 |
| 6,161,438 | A * | 12/2000 | Mullet et al. | 73/774 |
| 6,185,867 | B1 * | 2/2001 | McGuire | 49/109 |
| 6,346,889 | B1 * | 2/2002 | Moss | 340/686.1 |
| 6,715,234 | B1 * | 4/2004 | Libardi | 49/42 |
| 7,298,107 | B2 * | 11/2007 | McMahon | 318/466 |
| 7,360,695 | B2 * | 4/2008 | Ponert et al. | 235/382 |
| 7,392,617 | B2 * | 7/2008 | Wallerstorfer et al. | 49/47 |
| 2002/0050098 | A1 * | 5/2002 | Chan | 49/42 |
| 2007/0277439 | A1 * | 12/2007 | Ponert et al. | 49/44 |

FOREIGN PATENT DOCUMENTS

EP 331652 A1 * 9/1989

* cited by examiner

*Primary Examiner*—Jerry Redman
(74) *Attorney, Agent, or Firm*—Flynn, Thiel, Boutell & Tanis, P.C.

(57) ABSTRACT

A rotating barrier for a gateway includes a shaft mounted on a carrier. The shaft has fastened thereto at least one blocking arm which extends across the gateway in the blocking position. The blocking arm includes a sensor which detects a force exerted on the blocking arm in the blocking position and actuates a safety device when a given force is exceeded.

4 Claims, 1 Drawing Sheet

ROTATING BARRIER

FIELD OF THE INVENTION

This invention relates to a rotating barrier for a gateway.

BACKGROUND OF THE INVENTION

The support, the bearing of the shaft, the blocking arm and other parts of a rotating barrier must be formed to be extremely stable nowadays, since it can happen that e.g. an adult sits down on the blocking arm with his full weight or e.g. a skier tries to climb over the blocking arm with his skis. Avoiding damage to the rotating barrier through such abuse results in an overdimensioning of numerous parts of the rotating barrier which also involves considerable expense.

The problem of the invention is to prevent damage to the rotating barrier upon an improper action of force on the blocking arm.

SUMMARY OF THE INVENTION

According to the invention, a sensor is provided for detecting the load on the blocking arm. The sensor can be mounted e.g. on the blocking arm, the bearing of the shaft or the support. The sensor used can be a strain gauge, a piezoelectric element or, for example, a switch that is activated after a certain spring force is exceeded.

When the force acting on the blocking arm exceeds the given value, a safety device is actuated. This may be an optical and/or acoustic alarm device through which for example a 100 kg man sitting down on the blocking arm is prevented, optionally through a control person, from sitting down on the blocking arm with his full weight.

The rotating barrier can be one activated by the action of force of the person going in the passage direction. However, the invention is intended in particular for rotating barriers having an actuator for activating the shaft with the rotating arm.

When, in an actuator-operated rotating barrier, the force exerted on the blocking arm has exceeded the given value, the shaft is preferably driven to rotate the blocking arm downward, but without leaving the blocking position.

The downward rotation usually startles a person about to sit down on the blocking arm, so that he immediately relieves the blocking arm. For this purpose it can suffice that the blocking arm rotates downward only a little, i.e. assumes, for example, an angle of 30° or less relative to the horizontal in the lower blocking position. As long as proper blocking of the gateway is guaranteed in the lower blocking position of the blocking arm, however, the blocking arm has a greater angle, for example up to 45° or up to 60° relative to the horizontal, in the lower blocking position. This additionally causes the person sitting down on the blocking arm to slide off the blocking arm. At the same time, according to the parallelogram of forces, the force acting on the rotating barrier is reduced when the blocking arm assumes an angle as great as possible relative to the horizontal in the lower blocking position.

In addition to the partial rotation of the shaft from the upper to the lower blocking position when a given force on the blocking arm is exceeded, an alarm device can of course also be activated.

The given force that must be exceeded for the sensor to actuate the safety device, i.e. trigger the alarm and/or drive the actuator, so that the blocking arm is rotated into the lower blocking position can be less than one third of the gravity of an adult that is exerted on the free end of the blocking arm, i.e. the end facing away from the shaft, e.g. at least 300N. At the same time, 300 N is approximately the force at the end of the blocking arm at which a rotating barrier is still clearly felt to be blocked according to experience.

The sensor can also be so designed that it actuates the safety device only at a force acting on the blocking arm from above when this force is exceeded, but there is no actuation of the safety device when the same force acts on the blocking arm end laterally, i.e. in the transit direction.

The blocking arm rotated into the lower blocking position in case of load is preferably rotated back to the upper blocking position by the actuator after a given time of e.g. one or a few seconds.

The actuator is preferably a motor, in particular an electromotor. However, it can e.g. also be formed by an electromagnet, a piston/cylinder unit operable by a pressurizing medium, for example compressed air, or the like.

The shaft can have fastened thereto, for example, three blocking arms at a distance of 120° in each case. However, the shaft preferably has only one blocking arm or two blocking arms that are disposed at a distance of about 120 and 240°. The rotation axis of the shaft is preferably inclined to the horizontal by 30 to 60°, in particular about 45°, and the angle of the blocking arms or the one blocking arm to the rotation axis of the shaft is preferably 30 to 60°, preferably about 45°.

The carrier on which the shaft is mounted can be a stand supported on the ground, or any other carrier. The shaft can be mounted directly on the stand. It is also possible to mount the shaft on a cross member extending between two stands or on a cross member protruding laterally away from a stand.

The carrier preferably has the reading device fastened thereto, which, upon a valid reading of an access authorization, drives the actuator to rotate the shaft so as to release access.

In the case of radio frequency identification (RFID) transponders with the access authorization stored thereon, the reading device has a box-shaped housing with an antenna extending in the transit direction and from the top to the bottom, to be able to read RFID transponders whether, for example, in a child's trouser pocket or on an adult's headgear. The rotation axis of the shaft of the rotating barrier is preferably mounted in the middle area of the antenna and thus of the housing, so that as large a number of field lines as possible intersect the antenna of the transponder of the person standing in front of the blocking arm in the blocking position, thereby optimizing the reading.

Two such antennae and thus box-shaped housings can also be fastened to the stand, that is, in front of and behind the stand in the direction of passage. The two housings are then preferably fastened to only one stand, whereby the above-mentioned cross member on which the rotating barrier shaft is mounted can protrude away from the stand.

BRIEF DESCRIPTION OF THE DRAWINGS

Hereinafter the invention will be explained in more detail by way of example with reference to the enclosed drawing, in which.

DETAILED DESCRIPTION OF THE INVENTION

Figure 1:
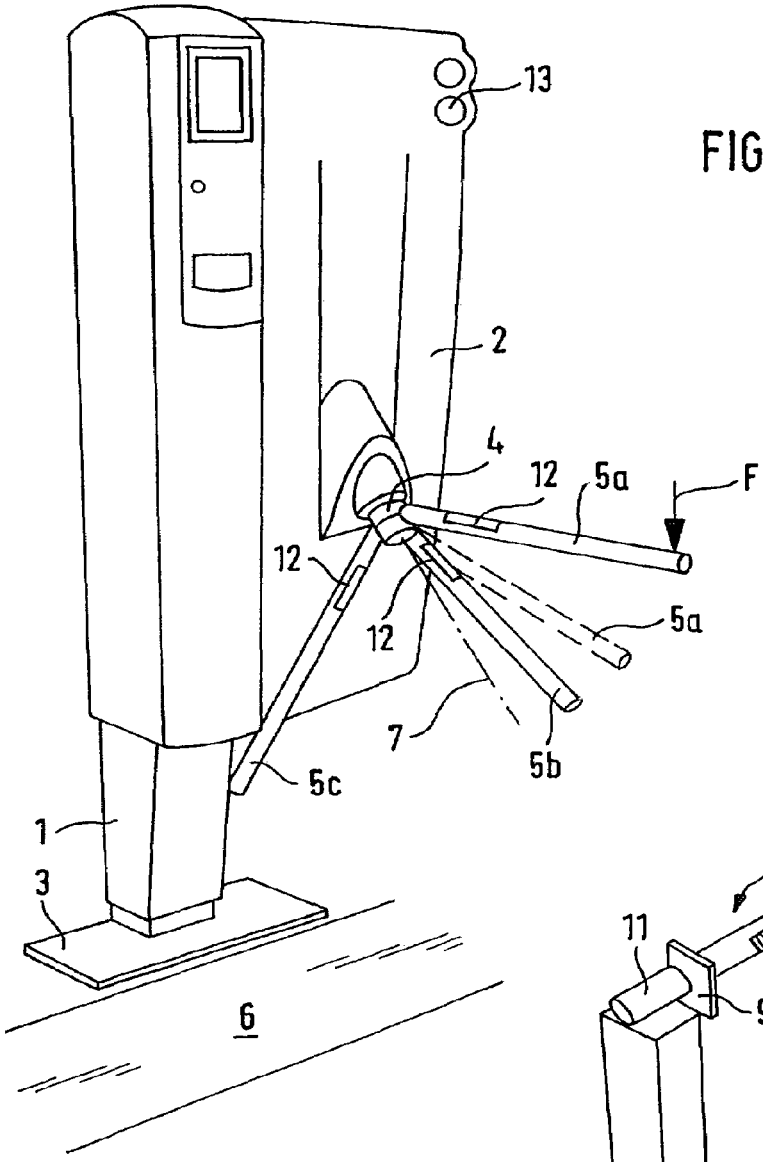
FIG. 1 shows a perspective view of a rotating barrier with an antenna housing and a shaft with three blocking arms.

According to FIG. 1, the rotating barrier has a stand 1 which carries a housing 2 and is supported on the ground with a plate 3. The housing 2 is disposed on the stand 1 in vertically displaceable fashion.

The housing 2 contains an RFID reading device with an antenna (not shown). The reading device can contactlessly read the access authorization stored in a transponder carried by an access authorized person.

In the middle area of the housing 2, the shaft 4 having three blocking arms 5*a*, 5*b* and 5*c* offset by 120° is pivot mounted. In the shown blocking position of the rotating barrier, the blocking arm 5*a* extends horizontally, across the gateway 6. The rotation axis 7 of the shaft 4 is inclined to the horizontal at an angle of about 45°. The angle between the blocking arms 5*a*, 5*b* and 5*c* and the rotation axis 7 is likewise about 45°.

Figure 2:
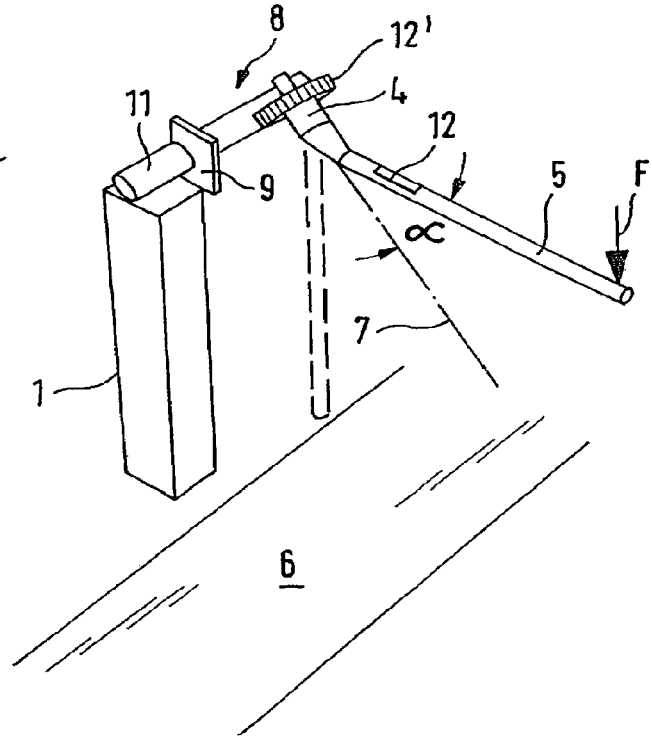
FIG. 2 shows a perspective view of a rotating barrier with the antenna housing and further part omitted, and of a shaft with only one blocking arm.

According to FIG. 2, only one blocking arm 5 is fastened to the shaft 4 and extends approximately horizontally, across the gateway 6, in the shown blocking position. As according to FIG. 1, the rotation axis 7 is also inclined relative to the horizontal by about 45° (angle $\alpha$).

The shaft 4 is mounted on a cross member 8 which extends laterally away from the stand 1 in the transit direction. At the upper end of the stand 1, a flange 9 is provided which carries an electromotor 11 for driving the shaft 4, whereby only the gearwheel 12' of the gearing is shown on the shaft 4 since the other gearing components are unessential for explaining the invention.

When a valid access authorization is read by the reading device in the housing 2 (FIG. 1), the motor 11 is actuated and thus the shaft 4 is rotated e.g. by about 180° according to FIG. 2, so that the one blocking arm 5 is rotated from the shown blocking position to the release position shown by dashed lines in FIG. 2, in which it protrudes downward and thus releases the gateway 6.

Each blocking arm 5, 5*a*, 5*b*, 5*c* is provided with a strain gauge 12. When a force F exceeding a given value is exerted from above on the blocking arm 5*a* in the blocking position according to FIG. 1, the motor 11 rotates the shaft 4 in the transit direction into the position shown by dashed lines in FIG. 1 which is between the position of the blocking arm 5*a* and the blocking arm 5*b* when the blocking arm 5*a* is located in its upper blocking position shown by unbroken lines. That is, the gateway 6 is still closed, but the blocking arm 5*a* has an angle of, for example, 30° relative to the horizontal in the lower blocking position shown by dashed lines.

The force F that must be exceeded for the motor 11 to be actuated by the strain gauge 12 to rotate the blocking arm 5*a* into the lower blocking position shown by dashed lines is, for example, at least one third of the weight of an adult, for example at least 300 N.

That is, if an adult tries to sit down on the blocking arm 5*a* in the (upper) blocking position according to the arrow F, said arm will rotate into the lower blocking position shown by dashed lines, which startles the person and makes him stop trying to sit on the blocking arm 5*a*. Furthermore, the strain gauge 12 can trigger an alarm which can be displayed with the optical alarm device 13.

After a period of e.g. a few seconds, the blocking arm 5*a* is rotated back by the motor 11 from the lower blocking position shown by dashed lines into the upper blocking position.

In the inventive rotating barrier, the blocking arms 5, 5*a*, 5*b*, 5*c*, the shaft 4, the carrier 8, the stand 1 and all other parts on which a torque acts when the blocking arm 5, 5*a*, 5*b*, 5*c* is loaded in the blocking position thus need only be designed for a given, accordingly reduced torque.

The invention claimed is:

1. A rotating barrier for a gateway comprising:

a carrier;

a rotatable shaft mounted on the carrier, the shaft including at least two blocking arms secured thereto, the blocking arms extending outwardly across the gateway in blocking positions based on rotation of the rotatable shaft;

a first force sensor secured to a first said blocking arm which detects a force exerted on the first blocking arm;

a second force sensor secured to a second said blocking arm which detects a force exerted on the second blocking arm; and a safety device that is actuatable by one of the first and second force sensors, wherein when one of the first and second force sensors senses at least a given force exerted onto the respective blocking arm, one of the first and second force sensor actuates the safety device.

2. The rotating barrier according to claim 1, including an actuator for actuating the shaft, and wherein the safety device comprises a control for activating the actuator to partially rotate one of the first and second blocking arms downwardly within the blocking position in response to the respective force sensor sensing the given force.

3. The rotating barrier according to claim 1, wherein the force sensors each comprise a strain gauge positioned on the respective blocking arm whereby a person sitting on the respective blocking arm in the blocking position applies a downward force that is detected by the strain gauge.

4. The rotating barrier according to claim 1, wherein the first and second force sensors are disposed on the respective first and second said blocking arms so that, when one of said blocking arms is provided in said blocking position, the corresponding one of said force sensors is positioned to sense a downward force to a top of the blocking arm.

* * * * *